US010898016B1

(12) United States Patent
Hsu

(10) Patent No.: US 10,898,016 B1
(45) Date of Patent: Jan. 26, 2021

(54) ILLUMINATED DOME SCENE CUP

(71) Applicant: Lorraine Melody Hsu, Santa Ana, CA (US)

(72) Inventor: Lorraine Melody Hsu, Santa Ana, CA (US)

( * ) Notice: Subject to any disclaimer, the term of this patent is extended or adjusted under 35 U.S.C. 154(b) by 0 days.

(21) Appl. No.: 16/739,307

(22) Filed: Jan. 10, 2020

(51) Int. Cl.

| | |
|---|---|
| ***F21V 21/00*** | (2006.01) |
| ***A47G 19/22*** | (2006.01) |
| ***F21V 23/04*** | (2006.01) |
| *F21W 121/00* | (2006.01) |
| *F21Y 115/10* | (2016.01) |

(52) U.S. Cl.
CPC ..... *A47G 19/2227* (2013.01); *A47G 19/2272* (2013.01); *F21V 23/0407* (2013.01); *F21V 23/0492* (2013.01); *A47G 2019/2238* (2013.01); *F21W 2121/00* (2013.01); *F21Y 2115/10* (2016.08)

(58) Field of Classification Search
CPC ..... A47G 19/2227; A47G 19/2222; A47G 19/2272; A47G 2019/2238; F21V 23/0407; F21V 23/0492; F21Y 2115/10; F21W 2121/00
USPC ..... 362/101, 276; 446/74, 77, 71, 72, 73; 206/217, 457; 220/707, 709
See application file for complete search history.

(56) References Cited

U.S. PATENT DOCUMENTS

| | | | | |
|---|---|---|---|---|
| 2,544,594 | A * | 3/1951 | Goldfarb | A47G 21/182 446/74 |
| 3,296,735 | A * | 1/1967 | Djedda | A63H 33/40 446/72 |
| 5,070,435 | A | 12/1991 | Weller | |
| 5,119,279 | A | 6/1992 | Makowsky | |
| 5,178,450 | A * | 1/1993 | Zelensky | A47G 19/30 362/101 |
| 5,725,445 | A | 3/1998 | Kennedy et al. | |
| 5,807,156 | A * | 9/1998 | Owen | A61J 9/00 215/11.1 |
| 6,036,570 | A | 3/2000 | Nadel | |
| 6,903,874 | B1 | 6/2005 | Karterman | |
| 7,080,916 | B1 | 7/2006 | Ferrin et al. | |
| 7,264,532 | B2 * | 9/2007 | Chen | A47G 19/2227 446/200 |
| 2006/0274527 | A1 * | 12/2006 | Langone | G09F 13/04 362/276 |
| 2016/0015196 | A1 | 1/2016 | Lee | |
| 2016/0025326 | A1 * | 1/2016 | Gonchar | A47G 19/2227 362/127 |

FOREIGN PATENT DOCUMENTS

| | | |
|---|---|---|
| AU | 680726 | 9/1995 |
| CN | 108618528 A | 10/2018 |
| GB | 2242364 B | 3/1994 |

* cited by examiner

*Primary Examiner* — Laura K Tso
(74) *Attorney, Agent, or Firm* — Bacon & Thomas, PLLC

(57) ABSTRACT

A drinking vessel or beverage container such as a dome scene cup is illuminated by at least one light-up figurine, miniature, sculpture, model, or other decorative three-dimensional item that fits within an enclosure at the top of the cup. The three-dimensional item includes a self-contained lighting module with its own light source, motion sensing circuit, and power supply.

19 Claims, 1 Drawing Sheet

ILLUMINATED DOME SCENE CUP

BACKGROUND OF THE INVENTION

1. Field of the Invention

The invention relates to a dome scene cup illuminated by a light-up figurine, miniature, sculpture, model, or other decorative three-dimensional item positioned within a dome at the top of the cup.

2. Description of Related Art

Disposable plastic cups or beverage containers having a dome at the top have long been utilized by fast food outlets and convenience stores as an inexpensive and convenient way to serve beverages for carry-out by the consumer. The dome serves as a lid to prevent spillage of the contents of the cup, and is typically arranged with a hole to enable insertion of a drinking straw into the cup, so that the contents of the cup can be consumed without removing the dome/lid.

Recently, purveyors of beverages have included a divider between the top of the cup and the space under the dome, and filled the resulting space with objects or miniature dioramas having figurines, miniatures, sculptures, models, or other decorative items that increase the attractiveness of the cup and can be used for promotional purposes, as a seasonal item, or as a collectable. An example of a collectable dome scene cup was offered by Starbucks in Singapore as the "Limited Edition Starbucks Singapore Dome Shaker Cold Cup," the dome being provided with a scene containing symbols of Singapore, including a lion figurine.

An alternative way to add value to a cup has been to illuminate it. For example, LEDs can be placed within the base or on sides of the cup to create lighting effects that are enhanced by the material or structural features of the cup. Examples of illuminated cups or other drinking vessels or beverage containers are found in U.S. Patent Publication No. 2016/0015196, U.S. Pat. Nos. 7,080,916; 6,903,874; 6,036,570; 5,119,279 and 5,070,435, and Japanese Patent Publication No. 10-172309.

Of particular interest is U.S. Patent Publication No. 2016/0015196, which discloses a dome cup with an illuminated animal-shaped figurine positioned with the cup. However, unlike the dome scene cup of the present invention, the dome cup disclosed in U.S. Patent Publication No. 2016/0015196 places the figurine not in the dome, but rather on a false bottom at the base of the cup. The reason for placement of the lighting element at the bottom of the cup is that the circuitry, lighting elements, and switch for activating the lighting element, require a substantial amount of space, and must be isolated from the beverage-containing section of cup. While the figurine may be illuminated, the illumination is provided by a light pipe positioned between the figurine and an external LED situated in the base of the cup, rather than by an LED placed within the figure itself.

Other references of background interest with respect to cups, drinking vessels, or other beverage containers include Chinese Patent Publication No. CN108618528, which discloses a cup with an aquarium scene in the top, and Australian Patent Publication No. 680792, which discloses various containers with pop out "prizes."

In contrast to the previously-known illuminated cups, the present invention utilizes an LED, battery, and motion activation circuit placed within a figurine, miniature, sculpture, model, or other decorative three-dimensional item positioned within the cup, without requiring additional circuitry, a manual on/off switch, or a power supply external to the three-dimensional item that serves as the light source, thereby enabling the lighting element to be entirely self-contained. This type of self-contained illumination arrangement has previously been provided in toys intended to be played with as a separate or discrete unit, but not in the types of object found in a diorama of a cup. For example, motion activated light-up toys such as balls designed to illuminate when thrown or bounced, and that includes internal power sources and circuitry, are well known and widely available. Such motion or impact activated light-up toys conventionally include one or more LEDs, at least one small button-type power cell, and a motion or impact sensing switch sealed within the toy for safety. The switch closes the power circuit and causes the LED to turn on or flash for a predetermined period, such as a few seconds, following detection of motion or an impact.

An example of a ball or other object with a flashing LED arrangement is disclosed in U.K. Patent Publication No. 2,242,364. The circuit includes two LEDs and a circuit for causing the LEDs to flash at predetermined frequency and intensity in response to closing of a switch. The LEDs and circuitry may be embedded in a spherical elastomer to form a ball, or in other devices such a toy sword or crossing guard's stop sign.

U.S. Pat. No. 5,725,445 discloses a similar ball in which is embedded a pair of LEDs and a flasher circuit, but adds a motion sensor to activate the flasher circuit when the ball is bounced.

SUMMARY OF THE INVENTION

It is a first objective of the invention to provide a cup, drinking vessel, or beverage container that is inexpensive and simple to manufacture, and yet that has enhanced value as a promotional or seasonal item, or as a collectable.

It is a second objective of the invention to provide a cup, drinking vessel, or beverage container having a diorama or scene that includes at least one figurine, miniature, sculpture, model, or other decorative three-dimensional item.

It is a third objective of the invention to provide a cup, drinking vessel, or beverage container having a diorama or scene with an illumination feature.

One or more of these objectives is achieved by a preferred embodiment of the invention in which a cup, drinking vessel, or beverage container includes at least one illuminated figurine, miniature, sculpture, model, or other decorative three-dimensional item that fits within a dome at the top of the cup, drinking vessel, or beverage container, and that does not require connection to an external circuit, power source, or light source.

In an illustrated embodiment of the invention, the illuminated figurine, miniature, sculpture, model, or other decorative three-dimensional item includes a flexible outer layer in the shape of the decorative three dimensional items, the flexible outer layer fitting over a lighting module that includes an LED, power source made up of one or more button cells, and circuitry and components for activating the at least one LED in response to motion of the cup, drinking vessel, or beverage container in which the illuminated three-dimensional item is positioned. The illuminated three-dimensional item may be part of a scene that includes non-illuminated three-dimensional items and that is positioned in a dome-shaped enclosure at the top of the cup, drinking vessel, or beverage container, the dome-shaped enclosure also serving as a lid through which a straw may be inserted in order to enable a beverage to be consumed through the straw without risk of spillage.

Optionally, the lighting module of the illustrated embodiment may be provided with a plurality of LEDs of different colors, the LEDs being soldered or connected to both sides of a circuit board that also includes motion sensing and flasher circuit, as well as contacts of the one or more button cells that make up the power source. By including a motion sensing circuit, the need for a manual on/off switch is eliminated, thus allowing the lighted figure to be placed in the dome without additional wiring or circuitry to connect it to the manual switch.

In addition, the lighting module of the illustrated embodiment may include a transparent housing through which the at least one light source is visible. The transparent housing may have any shape that enables a sleeve to be fitted over the housing to form the illuminated figurine, miniature, sculpture, model, or other decorative three-dimensional item. Different sleeves may be fitted over the same lighting module to form a variety of different three dimensional items utilizing the same light sources and other electrical components.

Although referred-to in the detailed description as a "dome scene cup," it is intended that the invention include drinking vessels or beverage containers other than vessels or containers commonly referred to as "cups." In addition, although illustrated as a "dome," it is to be appreciate that the enclosure or space at the top of the cup in which the illuminated figurine, miniature, sculpture, model, or other decorative three-dimensional item is placed may have shapes other than a "dome" or hemispherical shape.

DETAILED DESCRIPTION OF THE PREFERRED EMBODIMENTS

Figure 1:
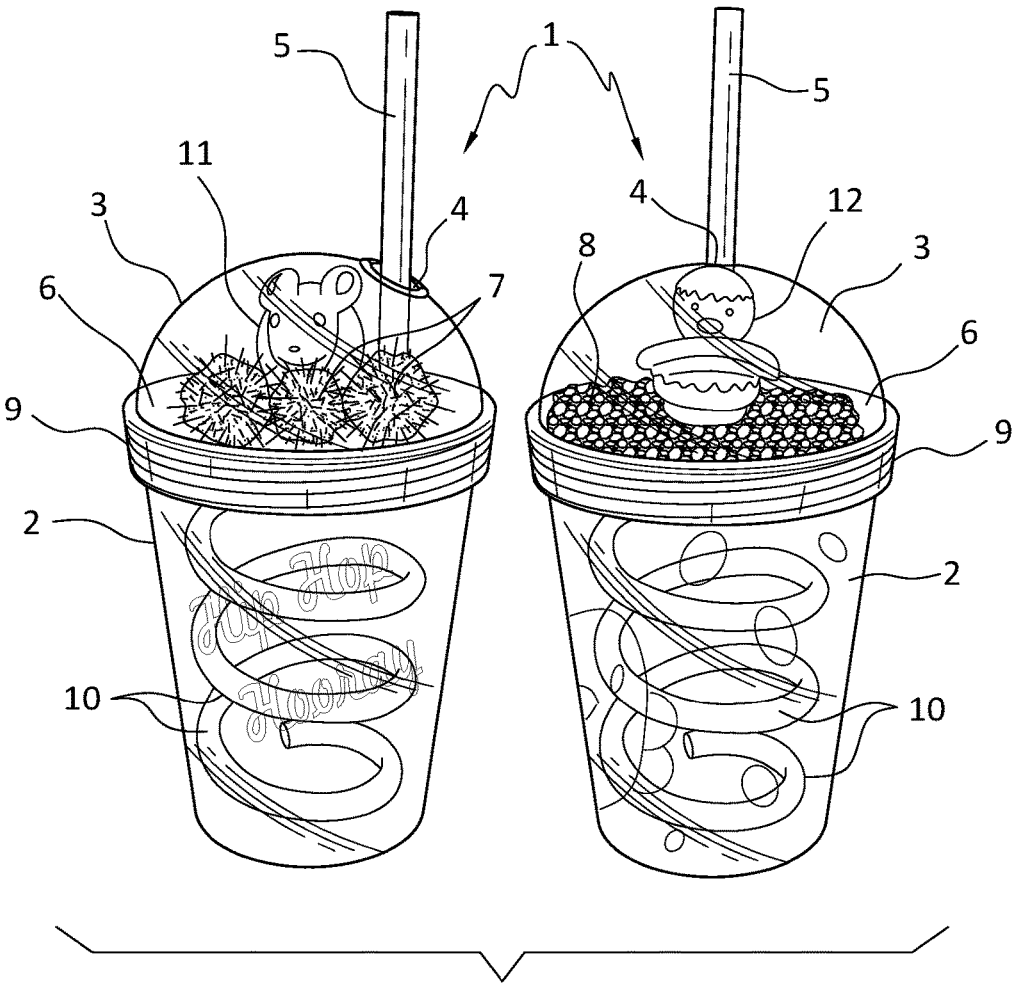
FIG. 1 is an isometric view showing two dome scene cups, each constructed in accordance with the principles of a preferred embodiment of the invention.

FIG. 1 shows examples of two illuminated dome scene cups 1 constructed in accordance with the principles of a preferred embodiment of the present invention. The two dome scene cups include different scenes and illuminated figurines, miniatures, sculptures, models, or other decorative three-dimensional items, but are otherwise identical.

Each of the dome scene cups 1 cup includes a conventional beverage-holding main body or container 2 and a dome 3 having an opening 4 to permit passage of a drinking straw 5. The dome 3 includes a planar or generally planar base or planar bottom 6 on which is positioned elements of a diorama or scene, such as plastic or cellophane structures 7 that resemble a hedge or bushes, and colored pieces 8 that provide a decorative covering for the base 6. The base 6 of the dome 3 also includes an opening (not shown) for passage of the straw 5, and a circumferential rim 9 shaped to removably engage an upper rim of the main body or container 2, and securely hold the dome 3 on the main body or container 2 in order to prevent spillage of a beverage that has been poured into the main body or container 2 before securing the dome 3 to the main body or container 2. The dome 3 must be at least partially transparent to enable a scene arranged on the base to be viewed from outside the cup. Although referred to as a "dome," the dome 3 may have shapes other than hemispherical, including shapes with flattened tops, cylindrical or pyramidal shapes, or irregular shapes such as a shape resembling the head of a cartoon mouse or other character. The main body 2 can be either opaque or at least partially transparent, may further include printed or painted artwork, messages, or other decorative or informationals elements, can have a variety of shapes and include additional features such as a handle, and can be made of any suitable liquid-holding material.

Those skilled in the art will appreciate that the illustrated scene elements, such as modeled bushes 7 or decorative pieces 8, are intended to be exemplary rather than limiting, and that any artistic, representational, or promotional elements that might occur to the artist or skilled artisan can be placed within the dome. In addition, the main body or container 2 may have a variety of different shapes, materials, decorations, and properties. For example, the main body or container 2 may be transparent, translucent, opaque, or have any combination of optical properties, and may have painted or printed designs or messages. In addition, conventional items such as the straw 5 may also be varied without departing from the scope of the invention, for example by including an optional spiral section 10 as illustrated in FIG. 1.

Each of the dome scene cups 1 illustrated in FIG. 1 further includes a respective light-up figurine, miniature, sculpture, model, or other decorative three-dimensional item 11, 12 arranged to fit within and to be fixedly or removably secured to the base 6 of the dome 3. Although respectively illustrated as a bunny and chick to provide an Easter motif, items 11, 12 may take any form that is appropriate for the scene, season, message or promotion that the cup is intended to convey and/or represent.

Figure 2:
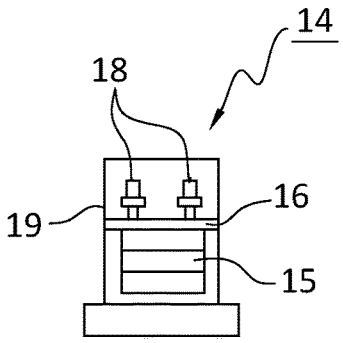
FIG. 2 is a side view of a lighting module for the preferred embodiment of the present invention.
Figure 3:
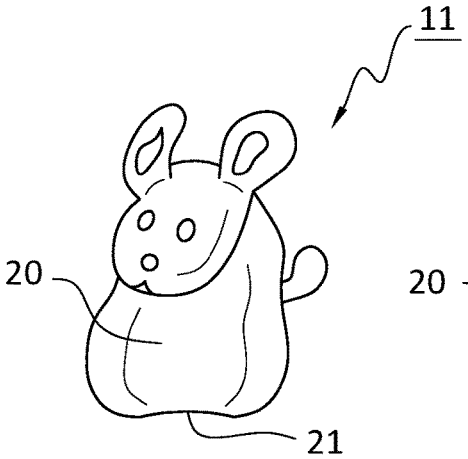
FIG. 3 is a side view of a sleeve into which the lighting module of FIG. 2 is placed to form a light-up figurine, miniature, sculpture, model, or other decorative three-dimensional item.
Figure 4:
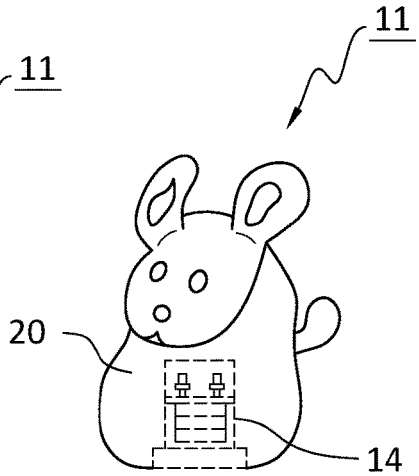
FIG. 4 is a light-up figurine, miniature, sculpture, model, or other decorative three-dimensional item made up of the lighting module of FIG. 2 and the sleeve of FIG. 3.

In the preferred embodiment, the light-up figurine, miniature, sculpture, model, or other decorative three-dimensional item 11, 12 is a modular assembly made up of a separate lighting module 14 and flexible sleeve 20 shaped to form the figurine, miniature, sculpture, model, or other decorative three-dimensional item 11 when fitted over a lighting module 14, as illustrated in FIGS. 2-4.

As best shown in FIG. 2, the lighting module 14 is a discrete unit that contains a power source, illustrated as three stacked button cells 15 positioned between a first contact (not shown) on a circuit board 16 and appropriate contacts (not shown) extending from the circuit board 16. One or multiple light sources in the form of LEDs 18 also extend from the circuit board and are visible through the housing 19 of the lighting module 14. The lighting module housing 19 may be made of any rigid or soft, transparent material, including but not limited to an acrylic, TPR, PMMA, PC, PET, or PP. For reasons of safety, the circuit board 16 may optionally be sealed within the module 14 to prevent access by a user. Finally, the LEDs 18 may have one or more different colors.

Included on the circuit board 16, but not shown, is circuitry for causing the LEDs to illuminate in response to motion, and in particular motion of a cup in which the light-up figurine, miniature, sculpture, model, or other decorative three-dimensional item 11, 12 is positioned, so as to eliminate the need for a manual on/off switch and the resulting additional wiring. In addition, the circuitry may include flasher circuitry for turning the lights on and off after a motion of the cup is sensed, and circuitry that limits the continuous activation or flashing to a predetermined interval of time, such as a few seconds. Such circuitry is well-known and commercially available, as are the LEDs 18, printed circuit board 16, the contact 17, and button cells 15, all of which may be varied without departing from the scope of the invention.

The housing 19 of lighting module 14 may have any shape, including but not limited to the illustrated cylindrical shape, which allows it to be fitted into the sleeve 20 shown in FIG. 3. If the housing 14 already has the shape of a figurine, miniature, sculpture, model, or other decorative three-dimensional item, then the flexible sleeve 20 of the illustrated implementation may be dispensed with.

The sleeve 20 of the illustrated implementation is preferably made of a flexible sheet of material 20 such as rubber, PP, or PET. An opening 21 at the bottom of the sleeve has a diameter smaller than that of the lighting module 14 but sufficient to enable the lighting module 14 to pass through the opening when the sleeve is stretched, so that the sleeve 20 fits over the lighting module 14 and the lighting module 14 is contained within the sleeve 20 to form the figurine, miniature, sculpture, model, or other decorative three-dimensional item 11, as shown in FIG. 4. The sleeve 20 may be colored so as to appear to be opaque when the module 14 is not inside sleeve 20, or when the lighting module 14 is within the sleeve 20 but not illuminated. However, the sleeve 20 should preferably be thin enough and made of a material capable of transmitting light when the LEDs are activated by motion or impact, so that the lighted LEDs 18 are visible when the lighting module 14 is within the sleeve 20. The same lighting module 14 may also be used, with an appropriately-shaped sleeve, for the chick-shaped figurine 12, or for any other figurine, miniature, sculpture, model, or other decorative three-dimensional item arranged to fit within a dome scene cup of the type illustrated in FIG. 1

The light-up figurine, miniature, sculpture, model, or other decorative three-dimensional item 11, 12 may be secured to the base 6 of the dome 3 by any suitable securing means, including an adhesive, a mechanical fastener, a cooperating peg and hole that provide an interference fit, and so forth. The securing means may permanently fix the light-up item in the dome, or enable removable after the beverage has been consumed. In addition, it will be appreciated that more than one light-up item may be placed in a single dome, and that the scene or diorama may be varied in numerous additional ways without departing from the scope of the invention.

What is claimed is:

1. An illuminated drinking vessel or beverage container, comprising:

a main body and an enclosure configured to be removably coupled to a top of the main body, the main body including an interior space for holding a beverage, and the enclosure configured to serve as a lid to prevent spillage of the beverage from the main body, the enclosure including a base, a rim configured to be secured to the main body, and a partially transparent top through which a scene arranged on the base may be viewed from outside the partially transparent top; and at least one three-dimensional light-up item having an interior power source, circuitry, and a lighting element, the three-dimensional light-up item being positioned on the base and arranged to illuminate when the drinking vessel or beverage container is moved, wherein the enclosure includes openings at a top and bottom of the enclosure to permit passage of a drinking straw through the enclosure and into an interior of the main body, to enable consumption of the beverage through the straw.

2. An illuminated drinking vessel or beverage container as claimed in claim 1, wherein the three-dimensional item is at least one of a figurine, miniature, sculpture, or model.

3. An illuminated drinking vessel or beverage container as claimed in claim 2, wherein the three-dimensional item has a character or animal shape.

4. An illuminated drinking vessel or beverage container as claimed in claim 1, wherein the three-dimensional light-up item includes a lighting module and a sleeve that fits over the lighting module, the sleeve having a decorative, representational, or promotional shape.

5. An illuminated drinking vessel or beverage container as claimed in claim 4, wherein the lighting element includes at least one LED.

6. An illuminated drinking vessel or beverage container as claimed in claim 5, wherein the lighting element includes a plurality of LEDs.

7. An illuminated drinking vessel or beverage container as claimed in claim 5, wherein the circuitry includes a motion sensing switch.

8. An illuminated drinking vessel or beverage container as claimed in claim 7, further comprising a flasher circuit that causes the at least one LED to flash for a predetermined period whenever movement of the drinking vessel or beverage container is detected.

9. An illuminated drinking vessel or beverage container as claimed in claim 8, wherein the at least one LED, the motion sensing switch, and the flasher circuit are mounted on a circuit board, and the circuit board is fixed within a transparent housing of the lighting module.

10. An illuminated drinking vessel or beverage container as claimed in claim 9, wherein the power source includes at least one button cell.

11. An illuminated drinking vessel or beverage container as claimed in claim 10, wherein the power source includes a plurality of button cells stacked on said circuit board and held in place by an electrical contact extending from the circuit board.

12. An illuminated drinking vessel or beverage container as claimed in claim 1, wherein the partially transparent top is dome-shaped.

13. An illuminated drinking vessel or beverage container as claimed in claim 12, wherein the drinking vessel or beverage container is a dome scene cup.

14. An illuminated drinking vessel or beverage container, comprising:

a main body and an enclosure configured to be removably coupled to a top of the main body, the main body including an interior space for holding a beverage, and the enclosure configured to serve as a lid to prevent spillage of the beverage from the main body, the enclosure including a base, a rim configured to be secured to the main body, and a partially transparent top through which a scene arranged on the base may be viewed from outside the partially transparent top; and at least one three-dimensional light-up item including a lighting module and a flexible sleeve, wherein the flexible sleeve has a decorative, representational, or promotional shape, wherein the lighting module has a transparent housing that encloses at least one button cell power source and at least one LED, wherein the flexible sleeve includes an opening that enables the lighting module to be inserted into the flexible sleeve, such that the flexible sleeve encloses the transparent housing of the lighting module to form the three-dimensional light-up item, and wherein the three-dimensional light-up item is positioned within the enclosure.

15. An illuminated drinking vessel or beverage container as claimed in claim 14, wherein the flexible sleeve is configured to transmit light when the LED is illuminated, and to appear to be opaque when the LED is not illuminated.

16. An illuminated drinking vessel or beverage container as claimed in claim 14, wherein the lighting module has a diameter, and wherein the sleeve includes an opening having a dimension smaller than a diameter of the lighting module to contain the lighting module within the sleeve when the sleeve is not stretched, and to enable the lighting module to pass through the opening when the sleeve is stretched.

17. An illuminated drinking vessel or beverage container as claimed in claim 14, wherein the lighting module housing further encloses a motion sensing switch configured to cause the LED to illuminate the three-dimensional item when the drinking vessel or beverage container is moved.

18. An illuminated drinking vessel or beverage container as claimed in claim 14, wherein the partially transparent top is dome-shaped.

19. An illuminated drinking vessel or beverage container as claimed in claim 18, wherein the drinking vessel or beverage container is a dome scene cup.

* * * * *